US011117011B2

(12) United States Patent
Markelov

(10) Patent No.: US 11,117,011 B2
(45) Date of Patent: Sep. 14, 2021

(54) SPORTS TRAINING DEVICE FOR CREATING ADJUSTABLE LOAD (VARIANTS)

(71) Applicant: Vadim Evgenevich Markelov, Petrozavodsk (RU)

(72) Inventor: Vadim Evgenevich Markelov, Petrozavodsk (RU)

( * ) Notice: Subject to any disclaimer, the term of this patent is extended or adjusted under 35 U.S.C. 154(b) by 188 days.

(21) Appl. No.: 16/086,276

(22) PCT Filed: Apr. 27, 2016

(86) PCT No.: PCT/RU2016/000247
§ 371 (c)(1),
(2) Date: Sep. 18, 2018

(87) PCT Pub. No.: WO2017/164763
PCT Pub. Date: Sep. 28, 2017

(65) Prior Publication Data

US 2020/0289869 A1 Sep. 17, 2020

(30) Foreign Application Priority Data

Mar. 23, 2016 (RU) ..... RU2016110738

(51) Int. Cl.
*A63B 21/062* (2006.01)
*A63B 21/00* (2006.01)
(Continued)

(52) U.S. Cl.
CPC ..... *A63B 21/0632* (2015.10); *A63B 21/0615* (2013.01); *A63B 21/075* (2013.01); *A63B 21/0728* (2013.01); *A63B 21/4035* (2015.10)

(58) Field of Classification Search
CPC ..... A63B 21/0615–0632; A63B 21/078–0783
See application file for complete search history.

(56) References Cited

U.S. PATENT DOCUMENTS 3,414,261 A 12/1968 Huebner
5,836,858 A * 11/1998 Sharff ..... A63B 21/0724 482/106

(Continued)

FOREIGN PATENT DOCUMENTS

CN 204134136 U 2/2015
EP 2 952 230 A1 12/2015

(Continued)

OTHER PUBLICATIONS

Machine translation of WO2015150279—Outdoor Fitness Apparatus (Year: 2015).*

(Continued)

*Primary Examiner* — Jennifer Robertson
(74) *Attorney, Agent, or Firm* — FisherBroyles, LLP

(57) ABSTRACT

A sports training device includes a stand, pivot axis, elements for a person training to apply force, and load device for creating an adjustable load. The load device includes weights and a U-shaped guide acting to protect against unauthorized removal of the weights, one end of which guide is connected via a bracket to the pivot axis, which is secured to the stand. The pivot plane of the load device is directed perpendicular or parallel or at an angle to a support surface. The center of mass of the load device is shifted, in the presence of even a minimal load, left or right from the pivot axis or coincides with the pivot axis. The elements for a person training to apply force are installed, relative to the load device, at a given height from the support surface in accordance with the direction of force from the person training and in accordance with the group of muscles receiving the load.

19 Claims, 5 Drawing Sheets

(51) Int. Cl.

| | |
|---|---|
| ***A63B 21/06*** | (2006.01) |
| ***A63B 21/072*** | (2006.01) |
| ***A63B 21/075*** | (2006.01) |

(56) References Cited

U.S. PATENT DOCUMENTS

| | | | |
|---|---|---|---|
| 7,361,125 | B2 | 4/2008 | Webber et al. |
| 2005/0096197 | A1 | 5/2005 | Webber et al. |

FOREIGN PATENT DOCUMENTS

| | | | |
|---|---|---|---|
| RU | 31976 | U1 | 9/2003 |
| RU | 134799 | U1 | 11/2013 |
| RU | 2515434 | C1 | 5/2014 |
| WO | 2015/150279 | A1 | 10/2015 |

OTHER PUBLICATIONS

Extended European Search Report received for EP Patent Application No. 16895628.2, dated Dec. 11, 2019, 8 pages.
International Preliminary Report on Patentability received for PCT application No. PCT/RU2016/000247, dated Oct. 4, 2018, 7 pages.
International Search Report dated Jan. 19, 2017 for PCT/RU2016/000247.
Office Action for Russian Patent Application No. 2016110738.

* cited by examiner

SPORTS TRAINING DEVICE FOR CREATING ADJUSTABLE LOAD (VARIANTS)

CROSS-REFERENCE TO RELATED APPLICATIONS

This application is a National Stage application of International Application No. PCT/RU2016/000247, filed Apr. 27, 2016, which claims the benefit of Russian Federation Patent Application No. 2016110738, filed Mar. 23, 2016, the disclosures of which are incorporated by reference herein in their entireties.

BACKGROUND

Field

The invention relates to sports and is a set of solutions interconnected by a single inventive concept, and in particular to devices, on the basis of which a "line-up" of exercise machines can be created, intended for extending the range of loads for all sets of the trainee's muscles, to be used as part of exercise machines protected against unauthorized theft of load weights used on outdoor grounds.

Description of the Related Art

Known is a "Loading device for creating an adjustable load for exercise (options), a load changing method in the training device and a set of weights for the training device" (see Patent JVs 2429038, cl. A63B21/00) comprising a set of selectable weights installed so as to enable selecting each weight and including it in the load being selected. The load selecting tool comprises a group of drives corresponding to each selectable weight and controlled by electronic devices.

Also known is an "Exercise Machine" designed as a fixed solid rigid metal structure comprising a loading assembly with handles and a swinging axis, with the weights guide rigidly installed between the weight travel stops in the vertical plane, and shaped as a curved rod with two straight-line portions with a bend (see U.S. Pat. No. 2,515,434, cl. A63B 21/00).

There is a known "Device for storage of exercise machine load weights" comprising load weights and an element of protection against unauthorized theft of load weights designed as a U-shaped metal pipe, as well as handles for applying the trainee's forces and a swinging axis (see Utility Model Patent No. 134799, cl. A63B21/00. Prototype).

A common drawback of the family patents and prototype is the lack of constructive ability to provide embodiments of exercise machines, on the basis of which a "line-up" of machines could be created to extend the load range for all sets of the trainee's muscles.

The said disadvantage is overcome in the solution proposed by the author.

SUMMARY

The objective of the proposed solution is extending the fleet of devices protected against unauthorized theft of load weights and aimed at workout and development of muscles both by grown-up and teenage trainees, by providing a "line-up" of exercise machines set up from embodiments of exercise machines for generating an adjustable load, using components that are similar in embodiment and functional purpose, such as: loading device, rack, swinging axis, and elements for applying the trainee's force, by repositioning them in various fixed and mutually oriented positions relative to the bearing surface.

The technical result consists in extending the range of adjustable load exercise covering all sets of the trainee's muscles, thus enhancing the efficiency of exercise.

To achieve the technical result, the proposed solution in its first embodiment comprises a rack, a swinging axis, elements for applying the trainee's force, and a loading device to generate an adjustable load, comprising load weights and a U-shaped guide performing the function of protection against unauthorized theft of load weights, one end of the said device being connected with a bracket to the swinging axis fixed on the rack, where in accordance with the proposed invention, the swinging plane of the said loading device is oriented perpendicular to the bearing surface. Under a minimum load, the centre of gravity of the loading device is shifted either to the left or right of the swinging axis, or coincides with it. The elements for applying the trainee's force are installed, relative to the said loading device, at a preset height A from the bearing surface, in accordance with the direction of the trainee's force and with the set of muscles to be loaded.

In the second embodiment, exercise machines to generate adjustable loads, comprising a rack, a swinging axis, elements for applying the trainee's force, and a loading device to generate an adjustable load, comprising load weights and a U-shaped guide performing the function of protection against unauthorized theft of load weights, one end of the said device being connected with a bracket to the swinging axis fixed on the rack, where in accordance with the proposed invention, the swinging plane of the said loading device is oriented parallel to the bearing surface. Under a minimum load, the centre of gravity of the loading device is shifted either to the left or right of the swinging axis, or coincides with it. The elements for applying the trainee's force are installed, relative to the said loading device, at a preset height A from the bearing surface, in accordance with the direction of the trainee's force and with the set of muscles to be loaded.

In the third embodiment, exercise machines to generate adjustable loads, comprising a rack, a swinging axis, elements for applying the trainee's force, and a loading device to generate an adjustable load, comprising load weights and a U-shaped guide performing the function of protection against unauthorized theft of load weights, one end of the said device being connected with a bracket to the swinging axis fixed on the rack, where in accordance with the solution, the swinging plane of the said loading device is oriented at an angle to the bearing surface. Under a minimum load, the centre of gravity of the loading device is shifted either to the left or right of the swinging axis, or coincides with it. The elements for applying the trainee's force are installed, relative to the said loading device, at a preset height A from the bearing surface, in accordance with the direction of the trainee's force and with the set of muscles to be loaded.

In the fourth embodiment, exercise machines comprising a rack, a swinging axis, elements for applying the trainee's force, and a loading device to generate an adjustable load, comprising load weights and a U-shaped guide performing the function of protection against unauthorized theft of bad weights, one end of the said device being connected with a bracket to the swinging axis fixed on the rack, where in accordance with the proposed solution, the swinging plane of the said loading device is oriented perpendicular to the bearing surface, the centre of gravity of the loading device is shifted either to the left or right of the swinging axis or coincides with it under a minimum load, and the elements for applying the trainee's force are installed, relative to the said loading device, in accordance with the direction of the trainee's force and with the set of muscles to be loaded, the said device being provided with an additional link, whose one end is hinged to the rack, and the other end is hinged to the element for applying the trainee's force, enabling generation of a parallel link motion.

In the fifth embodiment, exercise machines comprising a rack, a swinging axis, elements for applying the trainee's force, and a loading device to generate an adjustable bad, comprising bad weights and a U-shaped guide performing the function of protection against unauthorized theft of bad weights, one end of the said device being connected with a bracket to the swinging axis fixed on the rack, where in accordance with the solution, the swinging plane of the said loading device is perpendicular to the bearing surface, the centre of gravity of the loading device is shifted either to the left or right of the swinging axis or coincides with it under a minimum load, and the said elements for applying the trainee's force are installed, relative to the said loading device, in accordance with the direction of the trainee's force and with the set of muscles to be loaded, the said device being additionally provided with a trainee's hand stop and a trainee's torso stop, a double-arm lever with a larger arm and a smaller arm, and an intermediate link installed on the rack to enable generation of a four-link mechanism with the rack and the loading device, the double-arm lever being hinged to the rack's lower part, the lower part of the said intermediate link being hinged to the smaller arm of the double-arm lever, and its top part being hinged to the loading device, with the element for applying the trainee's force rigidly fixed on the top part of the larger arm of the double-arm lever, and with the top part of the loading device hinged to the rack's top part.

Comparative analysis against the prototype revealed the following material features:

the loading device's swinging plane is oriented perpendicular to the bearing surface (first, fourth, and fifth embodiments), the loading device's swinging plane is oriented parallel to the bearing surface (second embodiment), the loading device's swinging plane is oriented at an angle to the bearing surface (third embodiment), under a minimum load, the centre of gravity of the loading device is shifted either to the left or right of the swinging axis, or coincides with it (first, second, third, fourth, and fifth embodiment), the elements for applying the trainee's force are installed, relative to the said loading device, at a preset height A from the bearing surface, in accordance with the direction of the trainee's force and with the set of muscles to be loaded (first, second, and third embodiment), the elements for applying the trainee's force are installed, relative to the said loading device, in accordance with the direction of the trainee's force and with the set of muscles to be loaded (fourth and fifth embodiment), the device is provided with an additional link, whose one end is hinged to the rack, and the other end is hinged to the element for applying the trainee's force, enabling generation of a parallel link motion (fourth embodiment), the device is additionally provided with a trainee's hand stop and a trainee's torso stop installed on the rack (fifth embodiment), the device is additionally provided with a double-arm lever with a larger arm and a smaller arm (fifth embodiment), the device is provided with an intermediate link installed to enable generation of a four-link mechanism with the rack and the loading device (fifth embodiment), the double-arm lever is hinged to the lower part of the rack (fifth embodiment), the lower part of the intermediate link is hinged to the smaller arm of the double-arm lever, and its top part is hinged to the loading device (fifth embodiment), the element for applying the trainee's force is rigidly fixed on the top part of the larger arm of the double-arm lever (fifth embodiment), the top part of the loading device is hinged to the top part of the rack (fifth embodiment).

Besides, the said machine may have more than one loading device (see FIG. 15), the said machine may have more than one element for applying the trainee's force (see FIG. 7), the exercise machine comprises supporting elements.

the said supporting elements are designed as a seat with or without a back, or as a bench, or as a foot rest, the supporting elements are rigidly joined to the rack, being fixed in intermediate positions by any known means, the supporting elements are movably joined to the rack, being fixed in intermediate positions by any known means, the force application elements are hinged to the loading device (see FIGS. 4, 8, 10, 12, 14), the said machine is additionally provided with handles, the handles are rigidly fixed either on racks or on loading devices, the machines are additionally provided with stops restricting the travel of the loading devices in the appropriate swinging planes in their extreme positions, the number of the said stops and their mounting locations are determined by the exercise machine's design features and by the trainee's safety, the double-arm levers and the intermediate links may be installed in the exercise machines in various combinations, numbering from one to two, the trainee's hand stop is installed on the rack enabling its length adjustment, to be fixed in intermediate positions in accordance with the anthropometric data of the trainee's arms, the torso stop is hinged to the rack to compensate for the trainee's torso anatomy, the said supporting element is designed as a seat without a back and fixed rigidly or movably relative to the rack, with subsequent fixing in intermediate positions by any known means.

The said material features ensure compliance of the claimed solution with the "Novelty" condition of patentability according to applicable law.

The author's analysis of state of the art, including research of patents and technological information sources, and detection of sources containing information on counterpart exercise machines showed that there are no parallel inventions characterized by features identical to all the material features of the proposed solution, and dividing a prototype from the list of counterparts enabled identification of a set of features of the claimed device material in relation to the technical results.

To check the compliance with the invention level requirement, the author did additional research and analysis to identify features coinciding with features differing from the selected prototype, whose results showed that the claimed solution in no way results from the known state of the art defined by the applicant, that is, comparison of the proposed invention not only to the prototype but also to other solutions in this and related areas of sports equipment showed that they do not contain features similar to the features distinguishing the claimed solution from the prototype.

This enables concluding on the compliance of the claimed exercise machine (embodiments) with the "inventive level" patentability condition according to applicable law.

BRIEF DESCRIPTION OF THE DRAWINGS

The essence of the invention is explained by drawings (see FIGS. 2 to 22).

Brief Description Of The Drawings

FIGS. 1, 3, 5, 7, 9, 11, 12, 14, 17, 19, and 21 show the initial and the extreme positions of all the movable parts of the exercise machine: loading device 1, stops "a" and "b", and force application elements 8.

The drawings are presented as kinematic diagrams to explain the "line-up" of exercise machines, therefore they do not indicate a precise dimensional ratio between particular structural elements.

Figure 1:
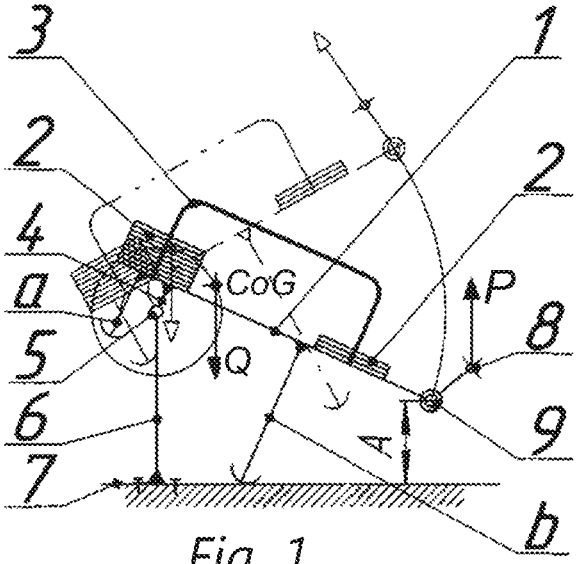

FIG. 1: General appearance and relative position of structural components of the exercise machine.

Figure 2:
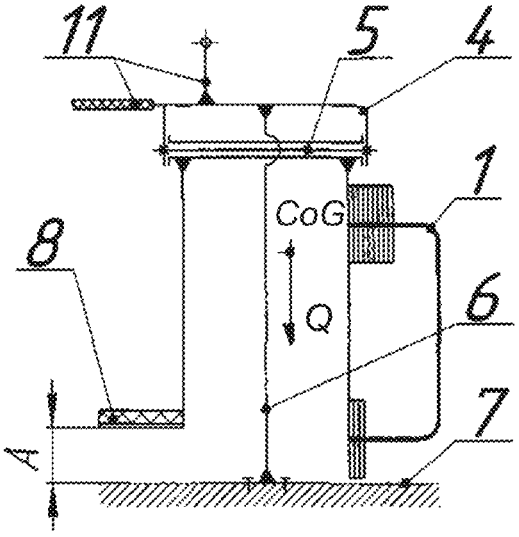

FIG. 2: Example 1. General appearance for a machine for exercise of lateral hip muscles, oblique abdominal muscles, and lat muscles FIG. 3: Example 2. General appearance of a machine for leg muscle exercise, or squats.

Figure 4:
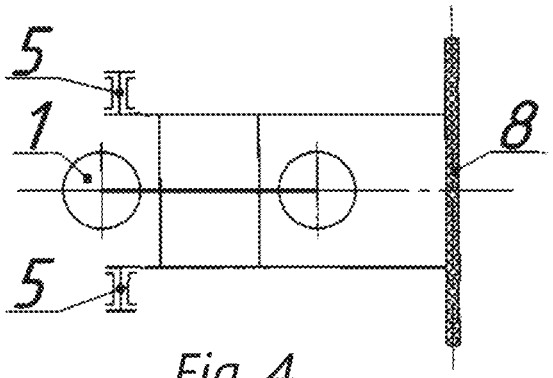

FIG. 4: Ditto. Top view

Figure 5:
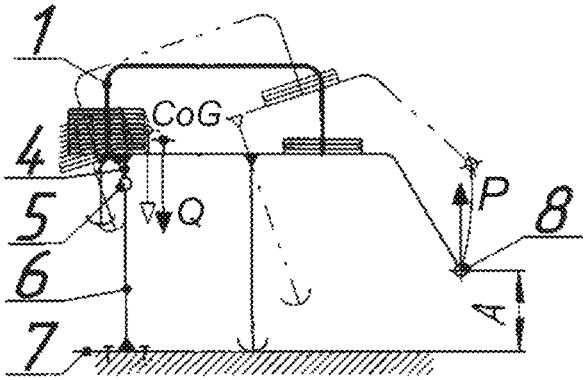

FIG. 5: Example 3. General appearance of a machine for exercise of back muscles (deadlift) and leg muscles.

Figure 6:
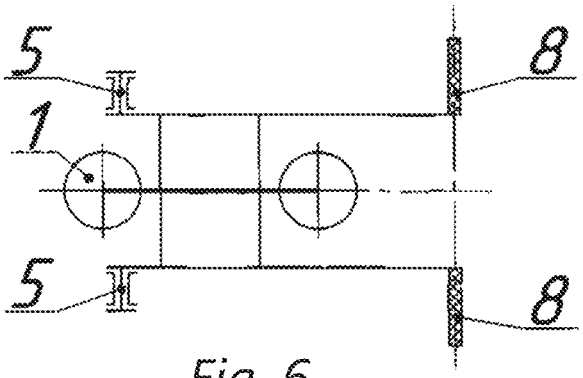

FIG. 6: Ditto. Top view

Figure 7:
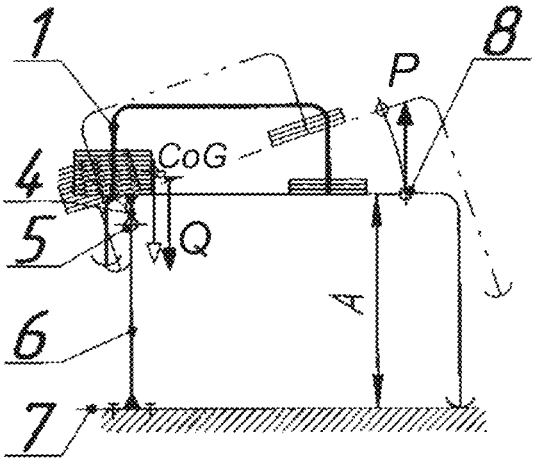

FIG. 7: Example 4. General appearance of a biceps exercise machine.

Figure 8:
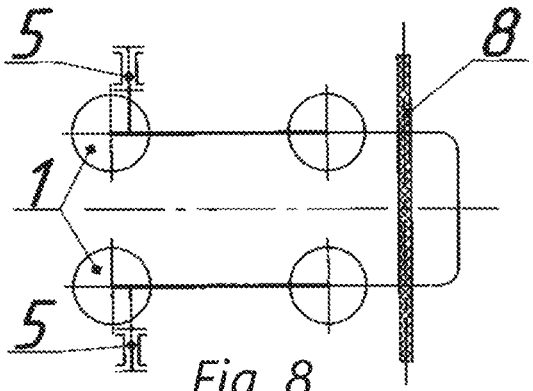

FIG. 8: Ditto. Top view

Figure 9:
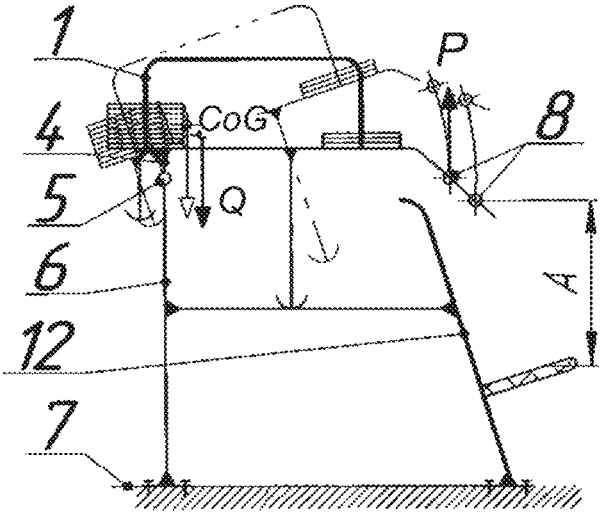

FIG. 9: Example 5. General appearance of a machine for "seated press up" exercise FIG. 10: Ditto. Top view FIG. 11: Example 6. General appearance of a machine for "seated press exercise FIG. 12: Example 7. General appearance of a seated triceps exercise machine.

Figure 13:
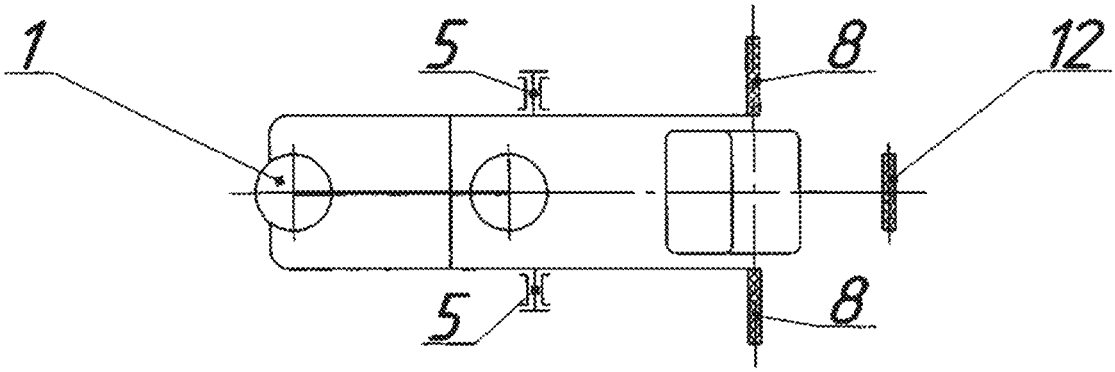

FIG. 13: Ditto. Top view

Figure 14:
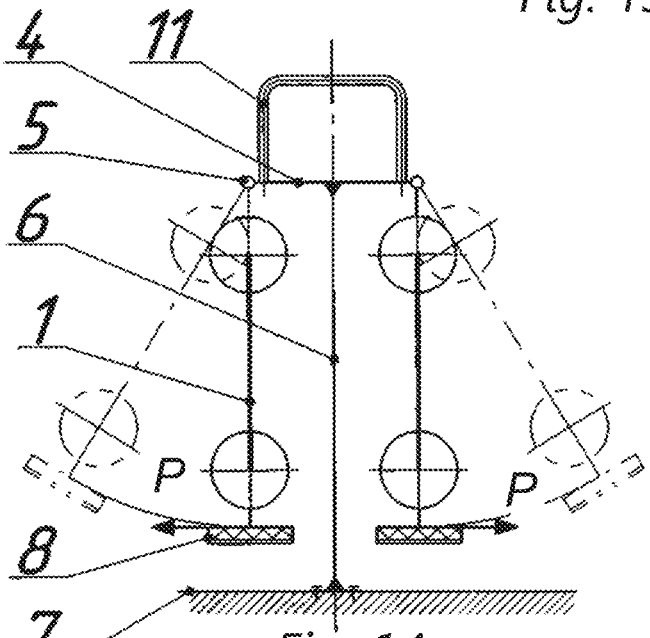

FIG. 14: Example 8. General appearance of a machine for hip muscle exercise and for flexibility gymnastic exercise, or "cross split".

Figure 15:
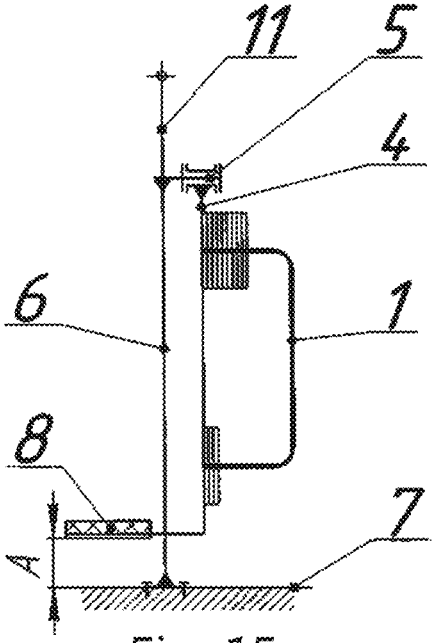

FIG. 15: Ditto. Left side view

Figure 16:
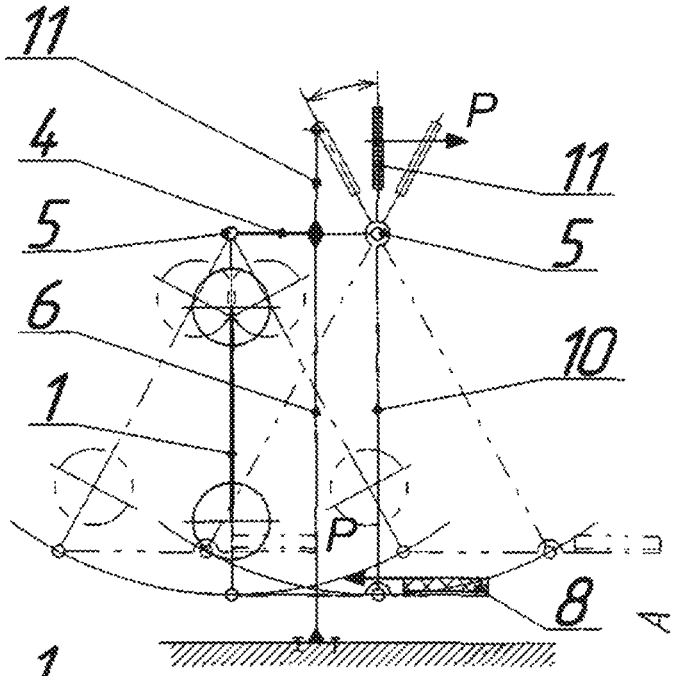

FIG. 16: Example 9. General appearance of a machine for alternate leg swinging exercises simulating "ski step".

Figure 17:
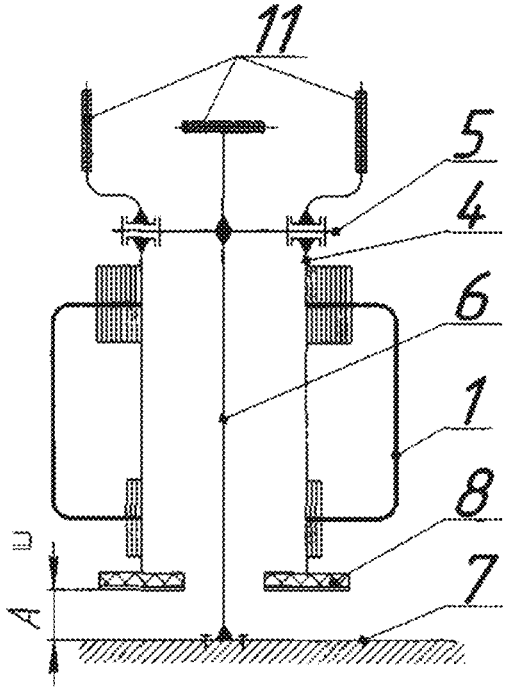

FIG. 17: Ditto. Left side view

Figure 18:
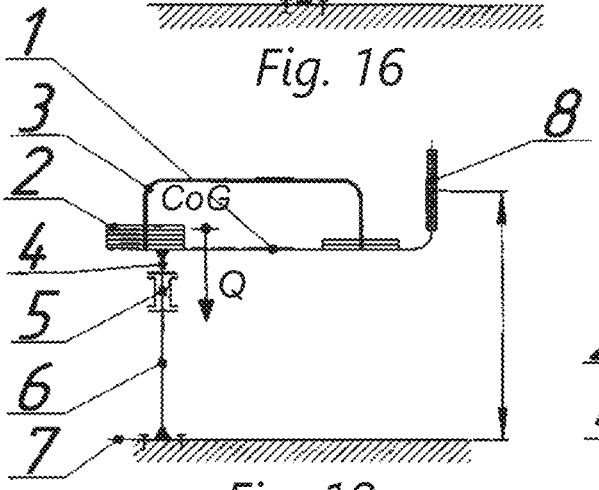

FIG. 18: Example 10. General appearance of a machine for tempo exercises improving shoulder muscle definition.

Figure 19:
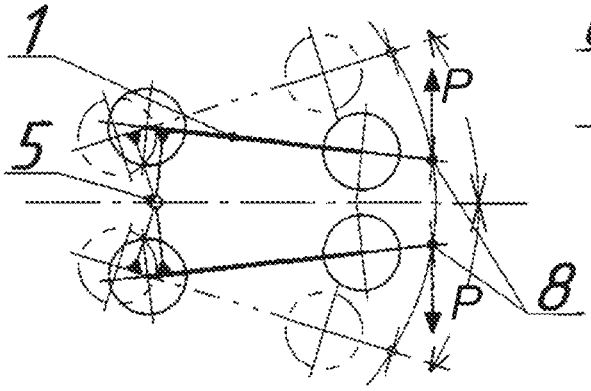

FIG. 19: Ditto. Top view

Figure 20:
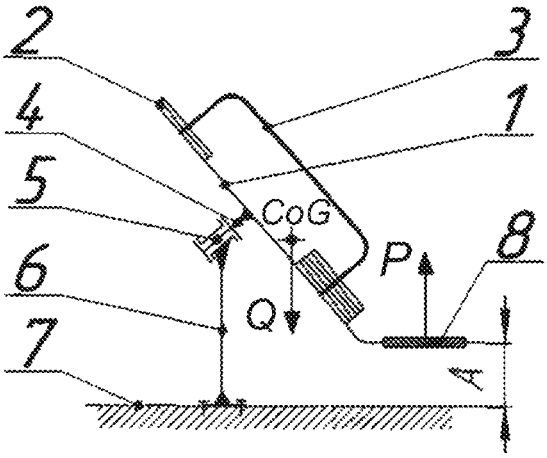

FIG. 20: Example 11. General appearance of a machine for shoulder and back exercise.

Figure 21:
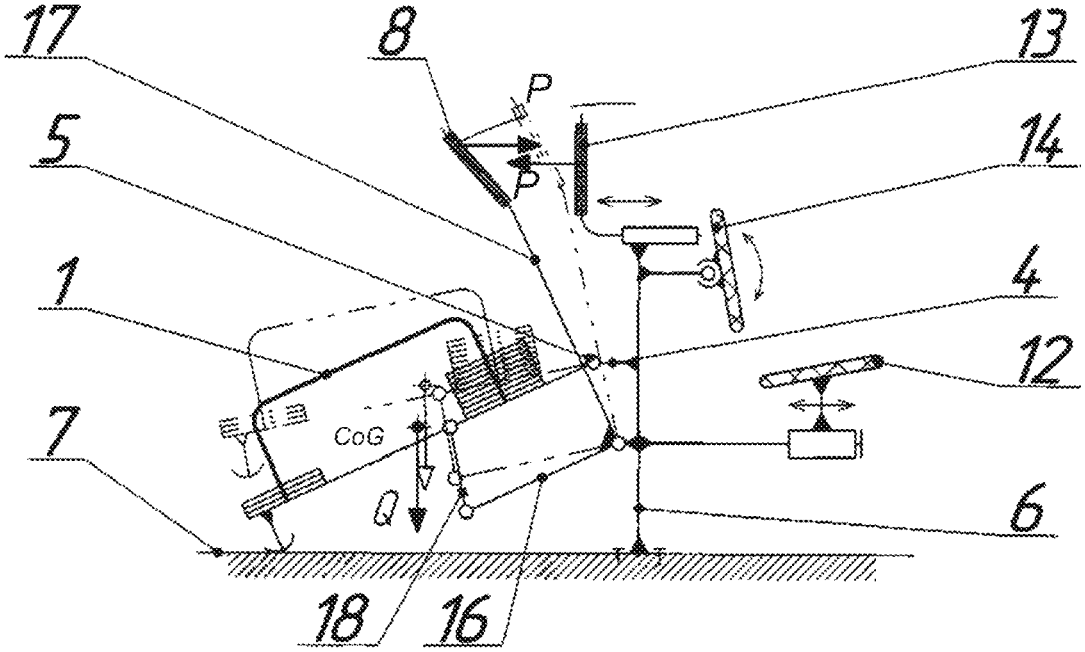

FIG. 21: Example 12. General appearance of a machine for "lever thrust" exercise.

Figure 22:
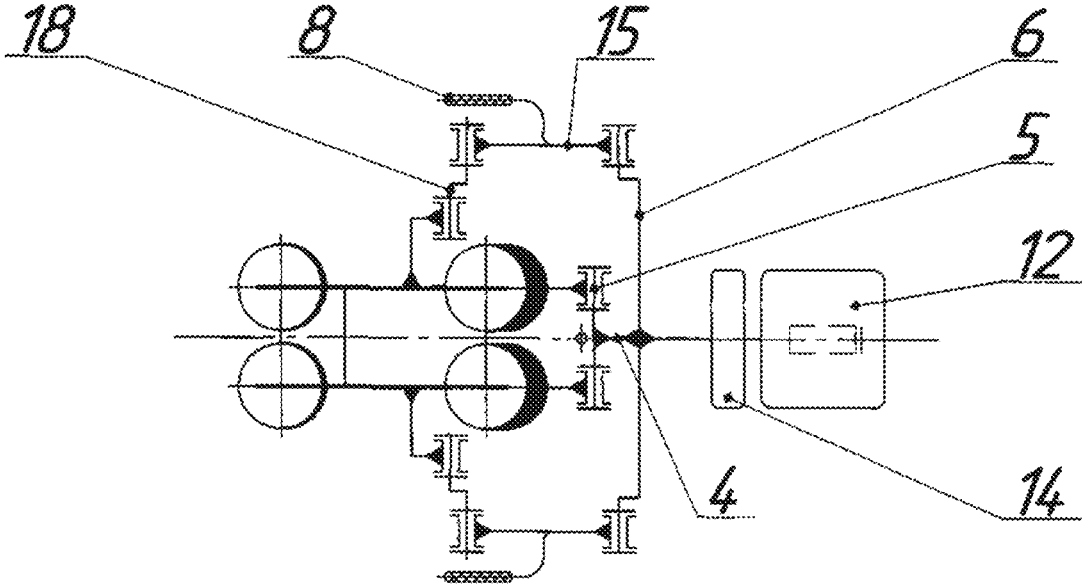

FIG. 22: Ditto. Top view

DETAILED DESCRIPTION

The technical problem set by the author for each of the exercise machine embodiments is solved as follows.

The design of the exercise machines in the line-up according to the first embodiment is that of exercise machines for generation of adjustable loads, comprising loading device 1 including load weights 2 and guide 3, which performs the function of their protection against unauthorized theft. Loading device 1 is mounted on bracket 4, which is installed on swinging axis 5 mounted on racks 6, which are fixed on bearing surface 7 (see FIG. 1). The swinging axis of loading device 1 is perpendicular to bearing surface 7 (the swinging plane of loading device 1 is in the drawing's plane, and swinging axis 5 is perpendicular to the drawing's plane).

For the trainee's safety, all the exercise machines are provided with thrusts "a" and "b" (see FIG. 1, shown conventionally) restricting the travel of loading devices 1 in the appropriate swinging planes in their extreme positions. Furthermore, the number of the said stops and their mounting locations are determined by the exercise machine's design features and by the trainee's safety.

To extend the range of adjustable loads, there may be more than one loading device 1 (see for instance FIG. 8).

Force application elements 8 are installed on loading device 1 rigidly or with hinge 9 (see FIG. 1). (The working surface of hinge 9 may be cylindrical or spherical). The use of hinge 9 enables changing the elements' motion path to apply force 8, and the direction of the vector of applying the force P thereto, which changes is the dynamics in the load on exercised sets of muscles, thus improving the qualitative level of the exercise process.

Figure 10:
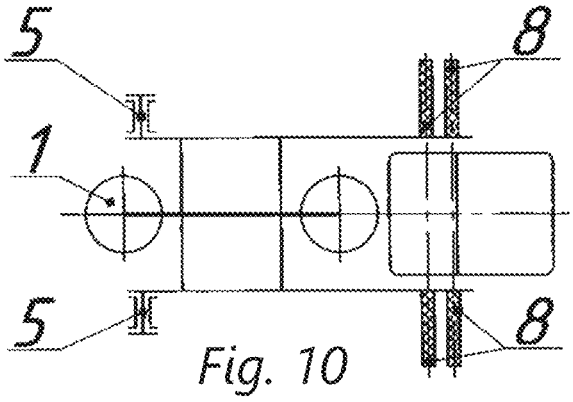
Figure 11:
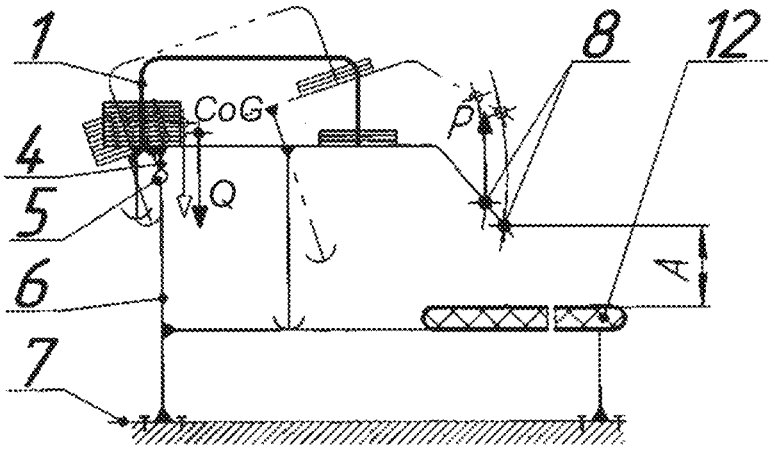

For easier use of the exercise machines, the distance A from force application elements 8 to bearing surface 7 is determined by the trainee's anthropometric data (such as height and arms' length), and the number of force application elements 8 designed as handles for gripping by the trainee's hands may exceed two (see FIGS. 9, 10 and 11).

In all embodiments of the exercise machine, on the basis of which the exercise machine "line-up" was created, the centre of gravity (CoG, RU-ЦТ) (see FIG. 1) of loading device 1 (at a minimum arm of load Q impact relative to swinging axis 5 (not shown in the drawing), in its initial position, may be arranged to the left of swinging axis 5 (in the drawing) (see for example FIGS. 12 and 21) or on the right (in the drawing) (see for example FIGS. 3, 5, 7, 9, 11, 18, and 20), or coincide with it (in the drawing) (see for instance FIG. 2). CoG (RU-ЦТ) may retain its position relative to swinging axis 5 (see for instance FIGS. 3, 5, 7, 9, 11, 12, 20, and 21) or deviate (see for instance FIGS. 2, 14, and 17) from the initial position at any position of loading device 1, including the extreme points of travel.

The elements for applying the trainee's force 8 may be installed, relative to loading device 1, at a preset height A (see FIG. 1) from the bearing surface 7, in accordance with the trainee's anthropometric data and with the direction P of the trainee's force and the set of muscles to be loaded.

The trainee applies force P to force application elements 8 (see FIG. 1) overcoming load Q, which is a resultant of the loading device weight (not shown in the drawing) and the load applied to the CoG point (RU-ЦТ). The bad P is determined by the value of the bad Q and location of CoG (RU-ЦТ) relative to swinging axis 5.

Some designs of the exercise machines provide handles 11 (see FIG. 16), installed either on rack 6 (fixed handles) or on loading devices 1 (movable handles), and supporting elements 12 (see FIGS. 8 to 12) designed as a bench or seat with or without a back.

The design of the exercise machines comprised in the "line-up" according to the second embodiment contains all the components of the first embodiment, except that the swinging plane of loading device 1 is parallel to bearing surface 7 (the swinging plane of loading device 1 is in the plane perpendicular to the drawing's plane, and swinging axis 5 is in the drawing's plane), (see FIG. 18).

The design of the exercise machines comprised in the "line-up" according to the third embodiment contains all the components of the first and second embodiments, except that the swinging plane of loading device 1 is at an angle to bearing surface 7 (the swinging plane of loading device 1 is in the plane perpendicular to the drawing's plane, and swinging axis 5 is in the drawing's plane), (see FIG. 20).

The design of the exercise machines comprised in the "line-up" according to the fourth embodiment comprises all the components of the first embodiment, except that elements for applying the trainee's force are installed, relative to the loading device, in accordance with the direction of the trainee's force and with the set of muscles to be loaded. Besides, to enable travel of the bearing surface of force application elements 8 (the latter are designed as footrests) parallel to bearing surface 7, the device is provided with additional link 10 (see FIGS. 16 and 17) whose one end is hinged to rack 6 via axis 5, and the other end is hinged (not shown in the drawing) to force application element 8, enabling generation of a parallel link motion consisting of the following links: loading device 1, additional link 10, force application element 8, and brackets 4. Handles 11 are provided in the top part of additional link 10. Besides, for convenient use of the machine, additional handle 11 is rigidly installed in the top part of rack 6 (see FIG. 17).

The swinging axis of loading device 1 (and thus the parallel link motion in general) is perpendicular to bearing surface 7 and lies in the drawing's plane (see FIG. 16). Swinging axes 5 are perpendicular to the drawing's plane.

The design of the exercise machines comprised in the "line-up" according to the fifth embodiment comprises all the components of the first embodiment, except that elements for applying the trainee's force 8 are installed, relative to loading device 1, in accordance with the direction of the trainee's force and with the set of muscles to be loaded. Besides, the device is additionally provided (see FIG. 21) with trainee's hand stop 13 and trainee's torso stop 14 installed on rack 6, with double-arm lever 15 (see FIG. 22) with smaller arm 16 and larger arm 17 (see FIG. 21), and with intermediate link 18 (see FIG. 21 and FIG. 22), which are installed to enable generation of a four-link mechanism with rack 6 and loading device 1. Double-arm lever 15 (not shown in the drawing) is hinged to the lower part of rack 6. The lower part (not shown in the drawing) of intermediate link 18 is hinged to the smaller arm 16 of double-arm lever 15, and its top part(not shown in the drawing) is hinged to loading device 1. Element for applying the trainee's force 8 is rigidly fixed on the top part (not shown in the drawing) of larger arm 17 of double-arm lever 15. The top part (not shown in the drawing) of loading device 1 is hinged to the top part (not shown in the drawing) of rack 6. Trainee's hand stop 13 is installed on rack 6 enabling its length adjustment, to be fixed by any known means (not shown in the drawing) in intermediate positions in accordance with the anthropometric data of the trainee's arms. Trainee's torso stop 14 is hinged (not shown in the drawing) to rack 6 to compensate for the trainee's torso anatomy. Supporting element 12 is designed as a seat without a back and fixed rigidly or movably relative to rack 6, with subsequent fixing (not shown in the drawing) in intermediate positions by any known means (see FIGS. 21 and 22).

Examples of embodiments of the proposed invention, which, in the author's intention, are to form a "line-up" of exercise machines:

Example 1 (see FIG. 2). Swinging axis 5 is rigidly installed on rack 6. Mounted on swinging axis 5 with brackets 4, both sides of rack 6, are loading device 1 and force application element 8 designed as a rest for the trainee's feet. The swinging planes of loading device 1 and force application elements 8 are perpendicular to bearing surface 7 (perpendicular to the drawing's plane). During exercise, the trainee rests on handles 11 rigidly installed both sides of rack 6 in the top part of the machine and arranged parallel to each other and to bearing surface 7. For the trainee's convenience, additional handle 11 is installed in the top part of rack 6. Furthermore, the height A of arrangement of force application elements 8 relative to bearing surface 7 is minimum, and the centre of gravity (CoG, RU-ЦТ) of the machine's movable parts shifts left-right relative to swinging axis 5 during exercise, passing the equilibrium point.

The result is an exercise machine that can be used, for example, for exercise of lateral hip muscles, oblique abdominal muscles, and lat muscles when doing leg swinging exercises with both legs simultaneously sideward.

Figure 3:
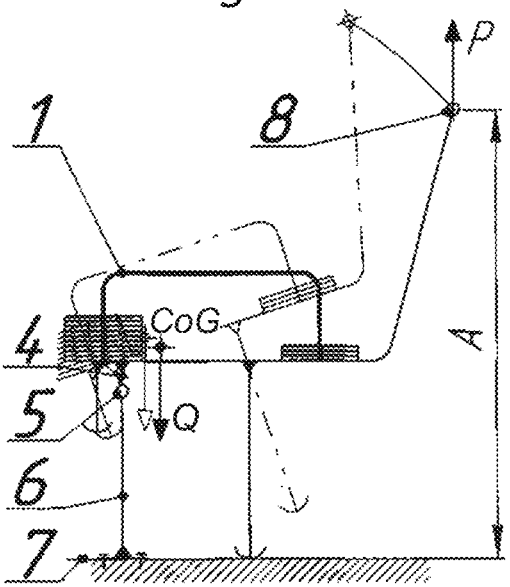

Example 2 (see FIG. 3, FIG. 4: Top view). The swinging plane of loading device 1 is perpendicular to bearing surface 7 (in the drawing's plane). Loading device 1 is installed on brackets 4 fixed on swinging axes 5 installed on racks 6. Force application element 8 is rigidly fixed on loading device 1 and may be, for example, a weight bar for gripping by the trainee's hands. The distance A is determined by the trainee's average anthropometric data, and by the distance to the top part of the trainee's shoulders in the upright position. Force application element 8 moves along an arc-shaped path. The result is an exercise machine that can be used, for example, for leg muscle exercise, or "squats."

Example 3 (see FIG. 5, FIG. 6: Top view). The difference of Example 3 from Example 2 is that the distance A is minimum. Force application elements 8 are designed as handles for gripping by the trainee's hands, and arranged both sides of loading device 1 (see FIG. 6).

The result is an exercise machine that can be used for exercise of back muscles (deadlift) and leg muscles.

Example 4 (see FIG. 7, FIG. 8: Top view). This example of the exercise machine has two loading devices 1 (see FIG. 8) installed in parallel and rigidly fixed on brackets 4 (see FIG. 1) fixed on swinging axis 5 installed on rack 6. The swinging plane of loading devices 1 is perpendicular to bearing surface 7 (in the drawing's plane). Force application elements 8 are rigidly fixed on loading devices 1 and may be, for example, a weight bar.

Force application elements 8 move along an arc-shaped path. In this case, the centre of gravity (CoG, RU-ЦТ) of loading devices 1 will always be to the right (in the drawing) of swinging axis 5 at any position of force application elements 8 and for any arrangement of all weights (not shown in the drawing) on loading device 1. The distance A is determined by the trainee's average anthropometric data, and by the distance from the trainee's elbow to bearing surface 7 in the upright position.

The result is an exercise machine that can be used, for example, for biceps exercise.

Example 5 (see FIG. 9, FIG. 10: Top view). The swinging plane of loading device 1 is perpendicular to bearing surface 7 (in the drawing's plane). Loading device 1 is installed on brackets 4 fixed on swinging axes 5 installed on racks 6. Force application elements 8 are rigidly fixed on loading device 1 and are designed as handles for gripping by the trainee's hands, two handles on each side of loading device 1. The exercise machine is provided with supporting element 12 designed as a seat with a back inclined at less than 90 degrees relative to the bearing surface. Force application elements 8 move along an arc-shaped path. The distance A from force application elements 8 to the seat (not shown in the drawing) corresponds to the averaged anthropometric data of the trainee for doing, for example, "seated press up" exercise, the centre of gravity (CoG, RU-ЦТ) of loading device 1 being always to the right (in the drawing) of swinging axis 5 for any position of force application elements 8 and for any arrangement of weights (not shown in the drawing) on loading device 1.

Example 6 (see FIG. 11). The exercise machine in Example 6 differs from the machine in Example 5 in that supporting element 12 is a bench. The distance A from force application elements 8 to the bench (not shown in the drawing) corresponds to the trainee's averaged anthropometric data.

The result is an exercise machine that can be used, for example, for "horizontal bench press" exercise.

Figure 12:
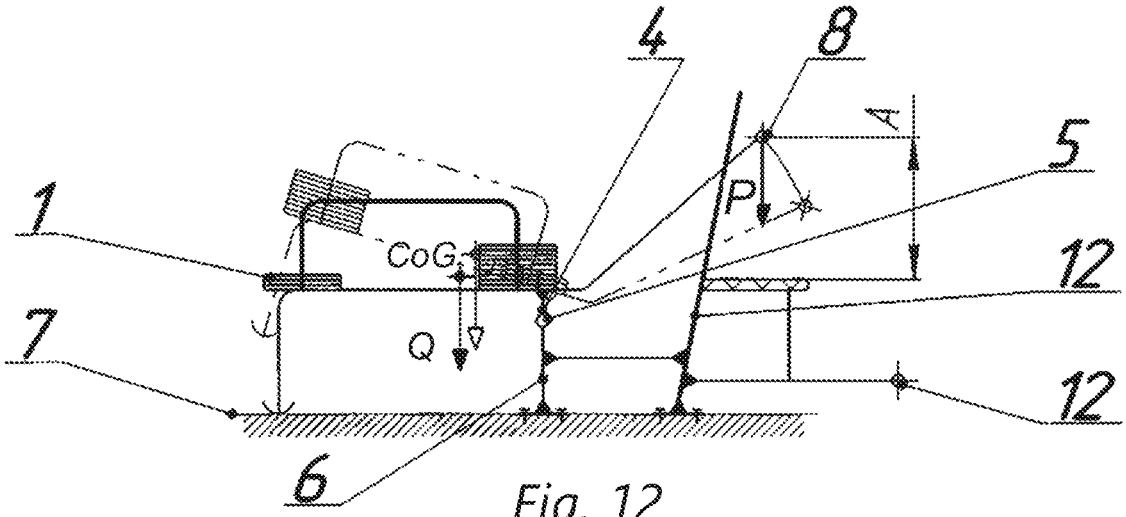

Example 7 (see FIG. 12, FIG. 13: Top view). The swinging plane of loading device 1 is perpendicular to bearing surface 7 (in the drawing's plane). Loading device 1 is installed on brackets 4 fixed on swinging axes 5 installed on racks 6. Force application elements 8 are rigidly fixed on loading device 1 and are designed as handles for gripping by the trainee's hands, arranged both sides of loading device 1. The exercise machine is provided with supporting element 12 designed as a seat with a back inclined at less than 90 degrees relative to the seat. The machine is provided with an additional supporting element 12 as a footrest. Force application elements 8 move along an arc-shaped path. The distance A from force application elements 8 to the seat's bearing surface (not shown in the drawing) is determined by the trainee's averaged anthropometric data, for instance for the "seated press up" exercise. In this case, the centre of gravity (CoG, RU-ЦТ) of loading device 1 will always be to the left (in the drawing) of swinging axis 5 at any position of force application elements 8 and for any arrangement of all weights (not shown in the drawing) on loading device 1.

The result is a triceps exercise machine.

Example 8 (see FIG. 14, FIG. 15: Left side view). To create an exercise machine, two loading devices 1 are used, fixed on brackets 4, on which swinging axes 5 fixed on rack 6 are installed. Loading devices 1 have a common swinging plane perpendicular to bearing surface 7 (in the drawing's plane) see FIG. 14). Force application elements 8 are arranged in the lower parts of loading devices 1, and are designed as a footrest with slip restraints for the trainee's feet (not shown in the drawing). Force application elements 8 are arranged at a minimum height A from bearing surface 7, and the distance from swinging axis 5 to bearing surface 7 exceeds the sum of the distance A and length of loading device 1. For the trainee's safety, and for easier use of the machine, handle 11 is fixed on rack 6.

The said exercise machine, when doing leg-swinging exercise in a counter opposing motion, may be used for example to exercise hip muscles, and when setting smaller loads, for flexibility gymnastic exercise, or "cross split".

Example 9 (see FIG. 16, FIG. 17: Left side view). In this example, the exercise machine has two loading devices 1 on one side of rack 6 (see FIG. 16), and two additional links 10 are installed on the other side.

Each of loading devices 1 in its top part is hinged upon brackets 4 fixed on swinging axis 5 installed on rack 6, and the lower part of each loading device 1 is hinged to one end of force application element 8. The top part of each of additional links 10 is hinged (not shown in the drawing) to brackets 4 via axis 5, and its lower part is hinged (not shown in the drawing) to the other end of force application element 8. Force application elements 8 are designed as a footrest with slip restraints (not shown in the drawing). The top parts of additional links 10 are designed as handles 11 for gripping by the trainee's hands. The swinging planes of all movable elements of the exercise machine (loading device 1, additional links 10, and force application elements 8 are perpendicular to bearing surface 7 (are in the drawing's plane) (see FIG. 16).

Furthermore, loading device 1, additional links 10, force application elements 8 and brackets 4 form a parallel link motion. The bearing surfaces of force application elements 8 travel parallel to bearing surface 7.

The result is an exercise machine that can be used, for example, for alternate leg swinging exercise simulating "ski step."

Example 10 (see FIG. 18, FIG. 19: Top view). The exercise machine for generation adjustable loads comprises loading device 1 comprising load weights 2 and guide 3 performing the function of protection against unauthorized theft of load weights 2. The swinging plane of loading devices 1 is parallel to bearing surface 7. Loading devices 1 are installed on brackets 4 fixed on swinging axes 5 installed on racks 6. Force application elements 8 are rigidly fixed on loading devices 1 and may be, for example, handles for gripping by the trainee's hands. Force application elements 8 move along an arc-shaped path in a counter opposing motion (see FIG. 19). The distance A is determined by the trainee's average anthropometric data, and by the distance from the trainee's elbow to bearing surface 7 in the upright position.

The result is an exercise machine that can be used for tempo exercise, for instance improving shoulder muscle definition.

Example 11 (see FIG. 20). The exercise machine for generation of adjustable loads comprises loading device 1 comprising load weights 2 and guide 3 performing the function of protection against unauthorized theft of load weights 2. The swinging plane of loading device 1 is at an angle to bearing surface 7. Loading device 1 is installed on bracket 4 fixed on swinging axis 5 installed on racks 6. Force application elements 8 are rigidly fixed on loading device 1 and may be, for example, handles for gripping by the trainee's hands. Force application elements 8 move along a curvilinear (arc-shaped) path.

The result is an exercise machine that can be used, for example, for shoulder and back muscle exercise.

Example 12 (see FIG. 21, FIG. 22: Top view) The exercise machine for generation of adjustable loads comprises loading device 1 comprising load weights 2 and guide 3 performing the function of protection against unauthorized theft of load weights 2. To provide the said exercise machine, the device is additionally provided with trainee's hand stop 13 and trainee's torso stop 14 installed on rack 6, with double-arm levers 15 (see FIG. 22) with smaller arms 16 and larger arms 17 (see FIG. 21), and intermediate links 18. Double-arm levers 15, intermediate links 18, rack 6 and loading devices 1 form a four-link mechanism. Double-arm levers 15 (not shown in the drawing) are hinged to the lower part of rack 6. The lower parts (not shown in the drawing) of intermediate links 18 are hinged to smaller arms 16 of corresponding double-arm levers 15, and their top parts (not shown in the drawing) are hinged to corresponding loading devices 1. On the top parts (not shown in the drawing) of larger arms 17 of double-arm levers 15, elements for applying the trainee's force 8 are rigidly fixed, designed as handles for gripping by the trainee's hands. The top parts (not shown in the drawing) of loading devices 1 are hinged to the top part (not shown in the drawing) of rack 6 via axes 5. Trainee's hand stop 13 is installed on rack 6 enabling its length adjustment, to be fixed by any known means in intermediate positions in accordance with the anthropometric data of the trainee's arms. Trainee's torso stop 14 is hinged (not shown in the drawing) to rack 6 to compensate for the trainee's torso anatomy. Supporting element 12 is designed as a seat without a back and fixed rigidly or movably relative to rack 6, with subsequent fixing (not shown in the drawing) in intermediate positions by any known means.

The result is an exercise machine that can be used, for example, for "lever thrust" exercise.

It should be noted that the claimed group of inventions meets the requirement of unity of invention, since the group of common-object inventions forms a common inventive concept, due to the fact that in the embodiments of the exercise machine (on which the "line-up" is based) on the basis of a loading device for generating adjustable loads, its same-type structural elements are used—that is, racks, brackets, swinging axis, elements for applying the trainee's force, and loading device for generating adjustable loads, comprising load weights and a U-shaped guide performing the function of protection against unauthorized theft of load weights.

The additional advantages of the proposed invention are evident from the above.

One of the advantages is that the "line-up" of exercise machines for generating adjustable loads proposed on the basis of the above embodiments uses same-type structural elements, such as racks, brackets, swinging axes, elements for applying the trainee's force, and loading device to generate adjustable loads. The use of a small number of same-type parts of a simple configuration in the manufacturing enables fast assembling of new exercise machine models at the design development stage, and will enable application of production process mechanization and automation in the future.

Another advantage is that the manufacturing will require a minimum number of material gauges to be used, thus reducing metal consumption and shortening the production period.

INDUSTRIAL APPLICABILITY

The proposed exercise machines do not present any difficulties in manufacturing, and have been utilized by industry. "Line-ups" of the exercise machine embodiments developed by the author are installed on outdoor sports grounds of the city of Petrozavodsk, and are widely used both by professional athletes and citizen of different age for exercise.

The above information testify for the claimed solution, as set forth in the claims, that it can be implemented with the use of known and proposed methods and tools.

Therefore, the proposed invention complies with the "Industrial applicability" patentability condition according to applicable law.

It should be borne in mind that the examples of invention embodiments as described in the application and shown in the drawings, are just possible options of its embodiment, while the nature and scope of the invention must be limited only to the material features included in the claims.

What is claimed is:

1. An exercise machine to generate adjustable loads, the exercise machine comprising:

a rack;

a swinging axis fixed on the rack;

elements for applying a trainee's force; and a loading device to generate an adjustable load, the loading device comprising load weights and a U-shaped guide performing a function of protection against unauthorized theft of load weights, one end of the said loading device being connected with a bracket to the swinging axis, a swinging plane of the said loading device being oriented perpendicular to a bearing surface, a centre of gravity of the loading device being either shifted to the left or right of the swinging axis or coinciding with the swinging axis under a minimum load, and the said elements for applying the trainee's force being installed, relative to the said loading device, at a preset height (A) from the bearing surface, in accordance with a direction of the trainee's force and with a set of muscles to be loaded, wherein a lever comprises a portion that extends between, and that is attached to, a first end and a second end of the U-shaped guide, the U-shaped guide comprising straight portions connected by angled portions.

2. An exercise machine to generate adjustable loads according to claim 1, wherein the elements for applying the trainee's force are hinged to the loading device.

3. An exercise machine to generate adjustable loads, the exercise machine comprising:

a rack;

a swinging axis fixed on the rack;

elements for applying a trainee's force; and a loading device to generate an adjustable load, the loading device comprising load weights and a U-shaped guide performing a function of protection against unauthorized theft of load weights, one end of the said loading device being connected with a bracket to the swinging axis, a swinging plane of the said loading device being oriented parallel to a bearing surface, a centre of gravity of the loading device being either shifted to the left or right of the swinging axis or coinciding with the swinging axis under a minimum load, and the said elements for applying the trainee's force being installed, relative to the said loading device, at a preset height (A) from the bearing surface, in accordance with a direction of the trainee's force and with a set of muscles to be loaded, wherein a lever comprises a portion that extends between, and that is attached to, a first end and a second end of the U-shaped guide, the U-shaped guide comprising straight portions connected by angled portions.

4. An exercise machine to generate adjustable loads, the exercise machine comprising:

a rack;

a swinging axis fixed on the rack;

elements for applying a trainee's force; and a loading device to generate an adjustable load, the loading device comprising load weights and a U-shaped guide performing a function of protection against unauthorized theft of load weights, one end of the said loading device being connected with a bracket to the swinging axis, a swinging plane of the said loading device being oriented at an angle to a bearing surface, a centre of gravity of the loading device being either shifted to the left or right of the swinging axis or coinciding with the swinging axis under a minimum load, and the said elements for applying the trainee's force being installed, relative to the said loading device, at a preset height (A) from the bearing surface, in accordance with a direction of the trainee's force and with a set of muscles to be loaded, wherein a lever comprises a portion that extends between, and that is attached to, a first end and a second end of the U-shaped guide, the U-shaped guide comprising straight portions connected by angled portions.

5. An exercise machine to generate adjustable loads according to claim 4, wherein the said exercise machine has more than one loading device.

6. An exercise machine to generate adjustable loads according to claim 4, wherein the exercise machine comprises supporting elements.

7. An exercise machine to generate adjustable loads according to claim 6, wherein the said supporting elements are designed as a seat with or without a back, or as a bench, or as a foot rest.

8. An exercise machine to generate adjustable loads according to claim 7, wherein the supporting elements are rigidly or movably joined to the rack, being fixed in intermediate positions.

9. An exercise machine to generate adjustable loads according to claim 4, wherein the elements for applying the trainee's force are hinged to the loading device.

10. An exercise machine to generate adjustable loads according to claim 4, wherein the exercise machine is additionally provided with handles.

11. An exercise machine to generate adjustable loads according to claim 10, wherein the handles are rigidly fixed either on the rack or on the loading device.

12. An exercise machine to generate adjustable loads according to claim 4, wherein the exercise machine is additionally provided with stops restricting travel of the loading device in the swinging plane in corresponding extreme positions.

13. An exercise machine to generate adjustable loads according to claim 12, wherein a number of the said stops and their mounting locations are determined by design features of the exercise machine and by safety of the trainee.

14. An exercise machine to generate adjustable loads according to claim 6 wherein the said supporting elements are designed as a seat without a back and fixed rigidly or movably relative to the rack.

15. An exercise machine to generate adjustable loads, the exercise machine comprising:

a rack;

a swinging axis fixed on the rack;

elements for applying a trainee's force; and a loading device to generate an adjustable load, the loading device comprising load weights and a U-shaped guide performing a function of protection against unauthorized theft of load weights, one end of the said loading device being connected with a bracket to the swinging axis, a swinging plane of the said loading device of the exercise machine being oriented perpendicular to a bearing surface, a centre of gravity of the loading device being either shifted to the left or right of the swinging axis or coinciding with the swinging axis under a minimum load, and the said elements for applying the trainee's force being installed, relative to the said loading device, in accordance with a direction of the trainee's force and with a set of muscles to be loaded, the said loading device being provided with an additional link whose one end is hinged to the rack, and the other end is hinged to the element for applying the trainee's force, enabling generation of a parallel link motion, wherein a lever comprises a portion that extends between, and that is attached to, a first end and a second end of the U-shaped guide, the U-shaped guide comprising straight portions connected by angled portions.

16. An exercise machine to generate adjustable loads, the exercise machine comprising:

a rack;

a swinging axis fixed on the rack;

elements for applying a trainee's force; and a loading device to generate an adjustable load, the loading device comprising load weights and a U-shaped guide performing a function of protection against unauthorized theft of load weights, one end of the said loading device being connected with a bracket to the swinging axis, a swinging plane of the said loading device being oriented perpendicular to a bearing surface, a centre of gravity of the loading device being either shifted to the left or right of the swinging axis or coinciding with the swinging axis under a minimum load, and the said elements for applying the trainee's force being installed, relative to the said loading device, in accordance with a direction of the trainee's force and with a set of muscles to be loaded, wherein a lever comprises a portion that extends between, and that is attached to, a first end and a second end of the U-shaped guide, the U-shaped guide comprising straight portions connected by angled portions, the loading device being additionally provided with a trainee's hand stop and a trainee's torso stop, a double-arm lever with a larger arm and a smaller arm, and an intermediate link installed on the rack to enable generation of a four-link mechanism with the rack and the loading device, the double-arm lever being hinged to a lower part of the rack, a lower part of the said intermediate link being hinged to the smaller arm of the double-arm lever, and a top part of the intermediate link being hinged to the loading device, with the elements for applying the trainee's force rigidly fixed on a top part of the larger arm of the double-arm lever, and with a top part of the loading device hinged to the top part of the rack.

17. An exercise machine to generate adjustable loads according to claim 16, wherein the double-arm lever and the intermediate link are installable in the exercise machine in multiple combinations.

18. An exercise machine to generate adjustable loads according to claim 16, wherein the trainee's hand stop is installed on the rack enabling its length adjustment to be fixed in intermediate positions in accordance with anthropometric data of arms of the trainee.

19. An exercise machine to generate adjustable loads according to claim 16, wherein the torso stop is hinged to the rack to compensate for anatomy of the trainee's torso.

* * * * *